US011402186B2

(12) United States Patent
Blecher et al.

(10) Patent No.: US 11,402,186 B2
(45) Date of Patent: Aug. 2, 2022

(54) EXPANDING BULLET

(71) Applicants: SHU Schuermann Hilleke Umformtechnik GmbH & Co. KG, Neuenrade (DE); RUAG Ammotec GmbH, Fuerth (DE)

(72) Inventors: Joerg Peter Blecher, Hagen (DE); Manfred Geier, Puchheim (DE); Florian Spanner, Nuremberg (DE)

(73) Assignees: SHU Schuermann Hilleke Umformtechnik GmbH & Co. KG, Neuenrade (DE); RUAG Ammotec GmbH, Fuerth (DE)

( * ) Notice: Subject to any disclaimer, the term of this patent is extended or adjusted under 35 U.S.C. 154(b) by 0 days.

(21) Appl. No.: 17/193,147

(22) Filed: Mar. 5, 2021

(65) Prior Publication Data

US 2021/0278181 A1 Sep. 9, 2021

(30) Foreign Application Priority Data

Mar. 6, 2020 (DE) ..... 20 2020 101 249.5
May 26, 2020 (DE) ..... 20 2020 102 983.5

(51) Int. Cl.
*F42B 12/34* (2006.01)

(52) U.S. Cl.
CPC ..... *F42B 12/34* (2013.01)

(58) Field of Classification Search
CPC ..... F42B 12/34
USPC ..... 102/506–510
See application file for complete search history.

(56) References Cited

U.S. PATENT DOCUMENTS 914,992 A * 3/1909 Taylor ..... F42B 12/34 102/510
1,101,743 A * 6/1914 Hoagland ..... F42B 12/34 102/508
4,882,822 A * 11/1989 Burczynski ..... F42B 12/34 86/54
5,811,723 A * 9/1998 Stone ..... F42B 12/34 102/509
2014/0026779 A1* 1/2014 Mekus ..... F42B 12/34 102/508
2017/0336186 A1* 11/2017 Smith ..... F42B 12/74
2019/0186881 A1* 6/2019 Spanner ..... F42B 12/74

FOREIGN PATENT DOCUMENTS

DE 20 2020 100 174 U1 2/2020

* cited by examiner

*Primary Examiner* — Reginald S Tillman, Jr.
(74) *Attorney, Agent, or Firm* — Collard & Roe, P.C.

(57) ABSTRACT

An expanding bullet having a one-piece structure has a cylindrical section and a section that is essentially shaped as a truncated cone, with the bullet tip being situated at the end of the latter section, which end faces away from the cylindrical section, and at least one planned breaking point being formed in this section, wherein the section shaped as a truncated cone is divided into segments and has a channel that has a mouth in the region of the bullet tip, wherein the channel has a bell-shaped widened region, which has its greatest diameter in the region of the transition from the cylindrical section to the section shaped as a truncated cone.

20 Claims, 1 Drawing Sheet

EXPANDING BULLET

CROSS REFERENCE TO RELATED APPLICATIONS

Applicants claim priority under 35 U.S.C. § 119 of German Application No. 20 2020 101 249.5 filed on Mar. 6, 2020 and German Application No. 20 2020 102 983.5 filed on May 26, 2020, the disclosures of which are incorporated by reference.

BACKGROUND OF THE INVENTION

1. Field of the Invention

The invention relates to an expanding bullet having a one-piece structure, which bullet has a cylindrical section and a section that is essentially shaped as a truncated cone, with the bullet tip being situated at the end of the latter section, which end faces away from the cylindrical section, and at least one planned breaking point being formed in this section, wherein the section shaped as a truncated cone is divided into segments and has a channel that has a mouth in the region of the bullet tip.

2. Description of the Related Art

An expanding bullet of the type stated initially is known, for example, from DE 20 2020 100 174 U1. Such bullets are characterized in that they are strongly braked after penetrating into the target, and thereby the bullet is prevented from passing through the target. The low penetration depth is achieved in that the bullet is bent open after penetrating into the target, in the region of the section shaped as a truncated cone, and thereby braking of the bullet is brought about. The planned breaking points provided in the section shaped as a truncated cone furthermore lead to tearing off of the segments, and thereby the effect of the bullet is increased.

SUMMARY OF THE INVENTION

The expanding bullets known from the state of the art meet the demands made on them. It is the task of the present invention to create an expanding bullet of the type stated initially, which has bullet properties that are just as good but at the same time can be produced more easily. This task is accomplished by means of the characteristics according to the invention.

With the invention, an expanding bullet is created, which is comparable, in terms of its effect, with known expanding bullets. However, on the basis of the design according to the invention, simpler and therefore more low-priced production is possible.

In a further development of the invention, at least one flaw is situated on the mantle surface of the section shaped as a truncated cone. The flaws lead to material weakening in the section of the bullet shaped as a truncated cone. They thereby increase the reliability with regard to unfolding and tearing off of the segments.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
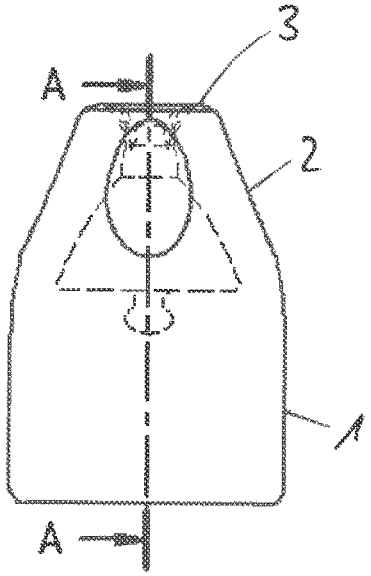
FIG. 1 shows a front view of an expanding bullet.

The expanding bullet selected as an exemplary embodiment has a single-piece structure. It has a cylindrical section 1 and a section 2 essentially shaped as a truncated cone. The bullet tip 3 is situated at the end of the section 2 shaped as a truncated cone that faces away from the cylindrical section 1. The section 2 shaped as a truncated cone is divided, in the exemplary embodiment, into four segments 4.1 to 4.4, which are brought about by means of incisions 5.1 to 5.4. In the region of the bullet tip 3, the expanding bullet has a mouth 6, which has a star-shaped shape.

Figure 2:
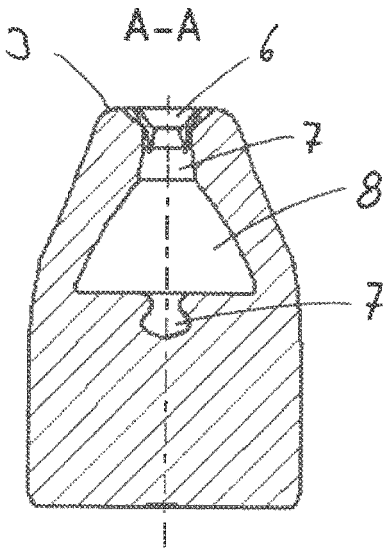
FIG. 2 shows the section through the expanding bullet along the line A-A in FIG. 1.
Figure 3:
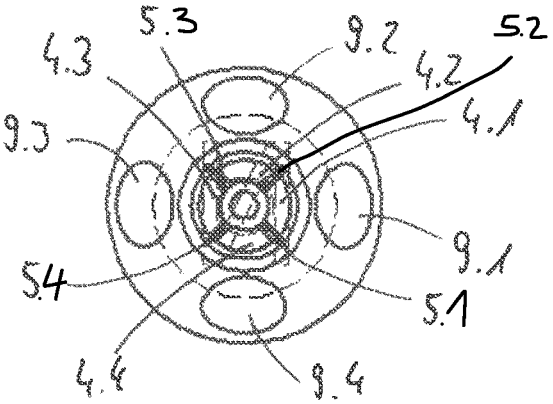
FIG. 3 shows the top view of the expanding bullet shown in FIG. 1.

The section 2 shaped as a truncated cone has a channel 7, which extends along the longitudinal axis of the expanding bullet. The channel 7 is configured in the manner of a dead-end bore. The channel 7 has a bell-shaped widened region 8, which has its greatest diameter in the region of the transition from the cylindrical section 1 to the section 2 shaped as a truncated cone (see FIG. 2).

In the exemplary embodiment, four flaws 9.1 to 9.4 are situated on the mantle surface of the section 2 shaped as a truncated cone 1. The flaws 9 are the result of the production process. This process can take place in a single massive-forming machine, and thereby transport of the semi-finished products is avoided. The production process is structured as follows:

The expanding bullet is produced from solid material, in the exemplary embodiment from copper wire. Other wire materials are also possible, depending on the application case. In the production of the expanding bullet according to the invention, the wire is first positioned in a forming machine. This can take place from a rolled-up wire coil, in cycled manner. The wire is then cut to length in the forming machine.

After the wire has been cut to length, in the next work step a radius is pressed onto the two end faces of the cut wire. Then one of the two end faces is center-punched. For this purpose, a tool that has a small hard tip is pressed into the end face, whereby a small circular depression is formed. This center-punched end face will later be the centering for the splitting tool. Subsequently, the end face provided with the center punch is split. This results in a crown-like or tulip-like shape, in the case of which four segments that are bent outward are brought about in the exemplary embodiment.

In the next processing step, using a cylindrical pin, material is pressed in the direction of the cylindrical section 1 that will form later. For this purpose, the cylindrical pin penetrates into the wire up to a specific depth from the split side, and pushes the material in front of it, whereby a planned breaking point occurs. After the pin is pulled out of the wire, the bullet shape is closed, whereby the bullet is finished. It then has the form that consists of the cylindrical section 1 and the section 2 essentially shaped as a truncated cone.

As the result of the displacement of the material using the pin, in the split state, a material-free region is formed, which region leads to the bell-shaped widened region 8 after the shape is closed. At the same time, the flaws 9 form on the mantle surface of the section 2 shaped as a truncated cone, when the shape is closed. These flaws lead to a further reduction of the wall thickness of the section 2 shaped as a truncated cone.

The expanding bullet according to the invention is very reliable and, at the same time, can be produced in simple and low-cost manner. High production speeds can be achieved, in particular, in the case of production on a single massive forming machine. As a result, the production costs are further reduced.

Although only a few embodiments of the present invention have been shown and described, it is to be understood that many changes and modifications may be made thereunto without departing from the spirit and scope of the invention.

The invention claimed is:

1. An expanding bullet having a one-piece structure, which bullet has a cylindrical section and a section that is essentially shaped as a truncated cone, with the bullet tip being situated at the end of the latter section, which end faces away from the cylindrical section, and at least one planned breaking point being formed in this section, wherein the section shaped as a truncated cone is divided into segments and has a channel that has a mouth in the region of the bullet tip, wherein the channel has a bell-shaped widened region, which has its greatest diameter in the region of the transition from the cylindrical section to the section shaped as a truncated cone.

2. The expanding bullet according to claim 1, wherein at least one flaw is situated on a mantle surface of the section shaped as a truncated cone.

3. The expanding bullet according to claim 1, wherein the mouth is formed as a conical diameter increase of the channel and/or the channel has a sectionally constant diameter between the mouth and the bell-shaped widened region.

4. The expanding bullet according to claim 2, wherein the mouth is formed as a conical diameter increase of the channel and/or the channel has a sectionally constant diameter between the mouth and the bell-shaped widened region.

5. A method for producing an expanding bullet, which bullet has a cylindrical section and a section that is essentially shaped as a truncated cone, with the bullet tip being situated at the end of the latter section, which end faces away from the cylindrical section, and at least one planned breaking point being formed in this section, wherein the section shaped as a truncated cone is divided into segments and has a channel that has a mouth in the region of the bullet tip, wherein the channel has a bell-shaped widened region, which has its greatest diameter in the region of the transition from the cylindrical section to the section shaped as a truncated cone, wherein the expanding bullet is produced by means of massive forming.

6. The method according to claim 5, wherein the expanding bullet is produced from wire, which is cut to length in a massive-forming machine and/or is center-punched at one end face with a graining tool.

7. The method according to claim 5, wherein the expanding bullet is produced from copper wire, which is cut to length in a massive-forming machine and/or is center-punched at one end face with a graining tool.

8. The method according to claim 5, wherein first an end face of a bullet blank is split into a plurality of segments and then a central recess is formed in the bullet blank starting from the split end face.

9. The method according to claim 6, wherein first an end face of a bullet blank is split into a plurality of segments and then a central recess is formed in the bullet blank starting from the split end face.

10. The method according to claim 8, wherein the end face of the bullet blank is split starting from a central depression introduced by the graining tool.

11. The method according to claim 8, wherein the central recess is formed by a cylindrical pin which, starting from the split end face, penetrates into the bullet blank up to a specific depth and presses material towards the cylindrical section.

12. The method according to claim 8, wherein the central recess is formed by a cylindrical pin which, starting from the split end face, penetrates into the bullet blank up to the transition from the cylindrical section to the section shaped as a truncated cone and presses material towards the cylindrical section.

13. The method according to claim 10, wherein the central recess is formed by a cylindrical pin which, starting from the split end face, penetrates into the bullet blank up to a specific depth and presses material towards the cylindrical section.

14. The method according to claim 10, wherein the central recess is formed by a cylindrical pin which, starting from the split end face, penetrates into the bullet blank up to the transition from the cylindrical section to the section shaped as a truncated cone and presses material towards the cylindrical section.

15. The method according to claim 8, wherein a bullet mold is closed after the central recess has been formed, wherein the segments are bent over in the direction of a central axis of the bullet to form the channel and the bell-shaped widened region.

16. The method according to claim 8, wherein a bullet mold is closed after the pin has been extracted from the bullet blank, wherein the segments are bent over in the direction of a central axis of the bullet to form the channel and the bell-shaped widened region.

17. The method according to claim 10, wherein a bullet mold is closed after the central recess has been formed, wherein the segments are bent over in the direction of a central axis of the bullet to form the channel and the bell-shaped widened region.

18. The method according to claim 10, wherein a bullet mold is closed after the pin has been extracted from the bullet blank, wherein the segments are bent over in the direction of a central axis of the bullet to form the channel and the bell-shaped widened region.

19. The method according to claim 11, wherein a bullet mold is closed after the central recess has been formed, wherein the segments are bent over in the direction of a central axis of the bullet to form the channel and the bell-shaped widened region.

20. The method according to claim 15, wherein at least one flaw is formed on a mantle surface of the section formed as a truncated cone when the bullet mold is closed.

* * * * *